US005203495A

United States Patent [19]

Jörgensen-Beck et al.

[11] Patent Number: 5,203,495

[45] Date of Patent: Apr. 20, 1993

[54] SALES AND DISPENSER BOX FOR PASTILS AND THE LIKE

[75] Inventors: Frode Jörgensen-Beck; Heinrich W. Lambach, both of Horsens, Denmark

[73] Assignee: Schur Engineering A/S, Horsens, Denmark

[21] Appl. No.: 768,987

[22] PCT Filed: May 22, 1990

[86] PCT No.: PCT/DK90/00128

§ 371 Date: Jan. 22, 1992

§ 102(e) Date: Jan. 22, 1992

[87] PCT Pub. No.: WO90/14278

PCT Pub. Date: Nov. 29, 1990

[30] Foreign Application Priority Data

May 22, 1989 [DK] Denmark ..... 2476/89

[51] Int. Cl.[5] ..... B65D 5/66

[52] U.S. Cl. ..... 229/225; 206/273; 229/160.1

[58] Field of Search ..... 229/146, 148, 160.1, 229/225, 228; 206/268, 273

[56] References Cited

U.S. PATENT DOCUMENTS

| | | | |
|---|---|---|---|
| 2,963,214 | 12/1960 | Leone et al. | 229/228 |
| 3,708,108 | 1/1973 | Rosenburg, Jr. | 229/225 |
| 4,732,276 | 3/1988 | Knecht | 229/225 |

FOREIGN PATENT DOCUMENTS

| | | | |
|---|---|---|---|
| 654558 | 12/1962 | Canada | 229/160.1 |
| 205766 | 12/1986 | European Pat. Off. | 229/160.1 |
| 380013 | 8/1964 | Switzerland | 229/160.1 |
| 948790 | 2/1964 | United Kingdom | 229/160.1 |
| 1023453 | 3/1966 | United Kingdom | 229/160.1 |
| 1603108 | 11/1981 | United Kingdom | 229/160.1 |

*Primary Examiner*—Gary E. Elkins

*Attorney, Agent, or Firm*—Antonelli, Terry, Stout & Kraus

[57] ABSTRACT

The invention relates to a cardboard sales and dispenser box of a pocket carry-type and of a hinged hood or a cap-like lid type. The present invention provides an effective snap-locking mechanism for engaging laterally projecting ear portions on opposed side edges of a front panel portion of the dispensing boxes. The laterally projecting ear portions engage respective recesses on the inside of opposed lateral lid skirt portions. The recesses are spaced within the inner side of the front lid skirt, adjacent to the corners thereof, and the edges of the side flap portions of the lid panel are folded flat against the outer lateral lid skirt portions constructed by the side folded outer flap portions of the front lid skirt. Thus, the hinged lid is effectively snap-locked when the projecting ear portions are received in the recesses while the lid is closed.

3 Claims, 3 Drawing Sheets

SALES AND DISPENSER BOX FOR PASTILS AND THE LIKE

BACKGROUND OF THE INVENTION

The present invention relates to cardboard packets of the hinged lid type, for example a box, which is particularly useful as a sales and pocket packing for pastils, and which has, at an open end, a hood or cap shaped lid comprising a lid panel hinged to one mouth wall portion of the box and skirt flaps projecting from the free edges of the lid panel over the three other mouth wall portions. The skirt flaps comprise a front flap and two opposed side flaps, and since these lid parts are interconnected, they will form a rigid caplike structure, which as a whole is hinged to one edge of the box opening.

Boxes of this type are easy to open, for example, with one finger, and they are well suited for pastils when the lid panel is directly hinged to an edge of the box opening, because the lid panel, when swung out through 90°, will form a straight extension of the box side to which it is hinged; when the box is held such that this side is the lowermost side, the opened lid will form a serving tray, onto which the pastils can be shaken out from the box, and from which even the last pastil can easily be picked up. On the other hand it is a serious problem when the lid is too easily opened, because the box may be intentionally opened.

Modified boxes are known; the so-called neck-boxes are particularly used for cigarettes, in which the lid panel is not directly to the rear box side, but hinged thereto through a short extension of that rear side, whereby the hinge axis is spaced from the rear corner of the lid panel. With this design, there will be a certain resistance against the lid structure being both opened and closed, because the front skirt of the lid will be forced be resiliently forced against the mouth edge of the box opposite to the hinge joint when the lid passes through its half-open position. This is a rather effective measure for a fully uncontrolled opening of the lid, but for pastil boxes, it is inconvenient because the open lid will serve as a serving tray, but merely a serving bowl, from which it is difficult to pick up the pastils at the bottom.

In the connection, with the packets of the last mentioned type, it has been attempted to provide for a better locking of the closed lid by means of laterally projecting tabs on the front mouth side of the box; these tabs may frictionally engage the inside of the side skirts of the lid, but this measure does not particularly improve the locking effect which has already been obtained by the neck design itself. The projecting tabs tend to deform the side skirts of the lid or to be deformed themselves, such that the frictional engagement is not too pronounced anyway. Examples of boxes of this type are disclosed in U.S. Pat. No. 3,874,581 and DE-OS 25 27 540.

SUMMARY OF THE INVENTION

Against this background the primary purpose of the present invention is to provide a box of the type referred to above, which is designed such that the hinged lid structure is effectively locked preventing unintentional opening.

According to the invention, this is achieved by using the proposed laterally projecting tabs on the front wall of the box opening not only for frictionally engaging the insides of the side skirts of the lid structure, but for cooperation with the snap locking notches at these insides. The notches are provided between the opposed corner areas of the front skirt portion of the lid and respective edges of cardboard material fastened to the inside of the side skirt portions. In practice, the arrangement may be very simple, because it is natural to cover the inner sides of the lid side skirts by flap portions folded out from the lid panel itself; then some of the material of these flap portions is cut away next to the inside of the front skirt portion in order to provide for notches to cooperate with the laterally projecting tabs.

The tabs, when normally received in the notches, will not be deformed or cause the side skirts to be deformed, and the locking action will not be dependent upon frictional engagement. The locking action results from the tabs being resiliently bent by the snap-out and the snap-in when the lid is opened and closed, respectively. These resilient bendings are not connected with any permanent deformation, and the snap locking engagement, therefore, is more fully effective throughout the lifetime of the packet, thus preventing the unintentional openings thereof.

Hereby, the first mentioned type of lid hinged boxes will be much more attractive, while also the neck-type closures will be improved by a stabilized holding of the lid in its closed condition.

BRIEF DESCRIPTION OF THE DRAWINGS

In the following description the invention is described in more detail with reference to the drawings, in which:

FIGS. 2–4 are perspective views illustrating the erection, filling and closing of the box, while

DESCRIPTION OF THE PREFERRED EMBODIMENTS

Figure 1:
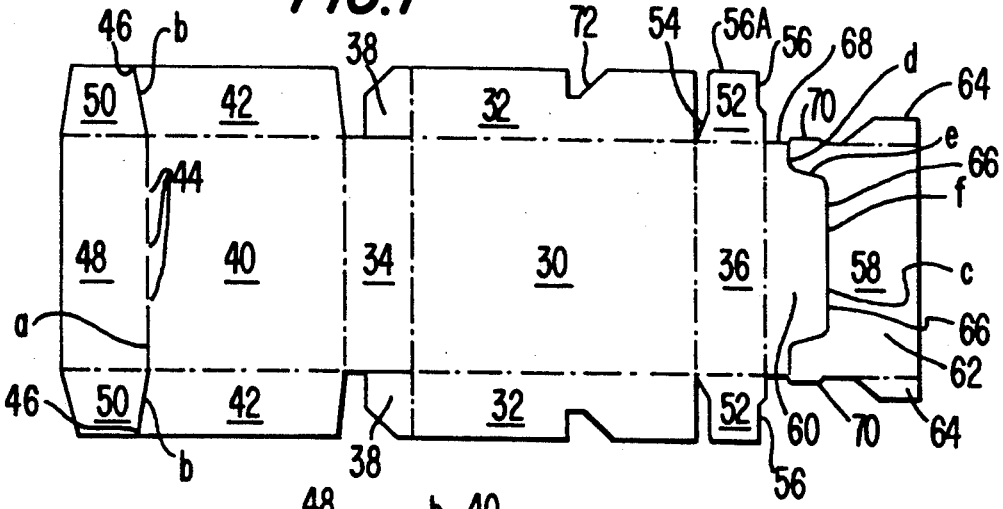
FIG. 1 is a plan view of a carton blank for the erection of a box according to the present invention.

The blank shown in FIG. 1 has a bottom panel 30 with side flaps 32 and end flaps 34 and 36. The flaps 32 continue at one end in corner lugs 38, and the flap 34 continues in a top panel 40 having side flaps 42. A line a is cut across the panel 40, with narrow breaks 44, and the cutting line continues in lines b across the flaps 42, leaving small uncut areas 46 at the outer line ends. The panel portions to the left of the cutting line are designated 48 and 50.

The end flap 36 is provided with side lugs 52, which are narrowed by recess cuttings 54 and 56, and it continues in a panel portion 58, which is cross divided in portions 60 and 62 by means of a cutting line c. The outer end of the panel 58 is provided with side lugs 64.

The cutting line c comprises outer cross line portions d continuing in portions e that coverge towards the right and are interconnected, through narrow non-cut areas 66, by a cross line portion f. The outer line portions d leave outermost uncut areas 68.

Next to these areas are formed small side ears 70 projecting just slightly from the opposed edges of this panel, just to the right of the lines d and without any folding line at the root of the ear portions.

Figure 2:
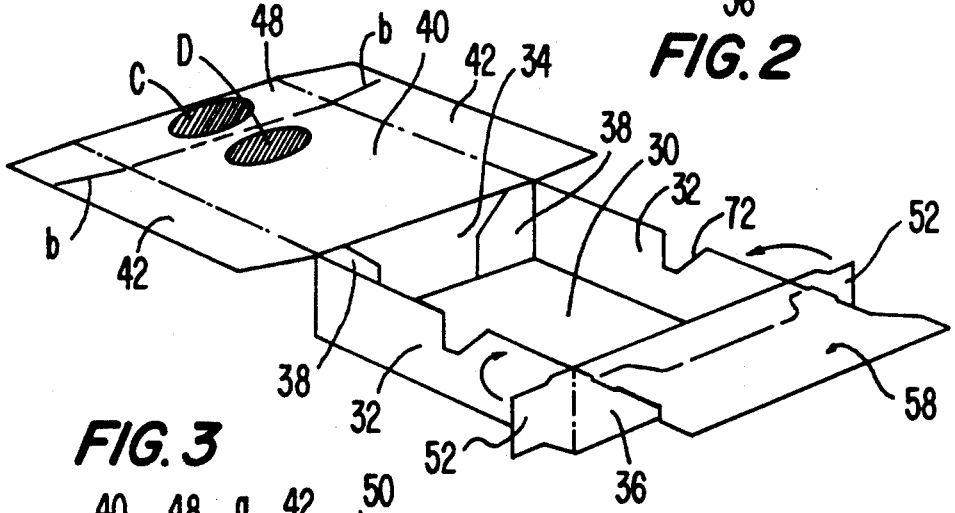

In FIG. 2, it is shown how the blank is erected into a condition ready for filling. The side flaps 32 are folded up and also the rear end flap 34 is folded up and preferably secured by gluing or welding to the lugs 38, while the top panel 40,48 is kept projecting rearwardly. At the opposite end of the bottom panel 30 the front end flap 36 is folded up, still with the side lugs 52 projecting outwardly and with the top side panel 58 folded horizontally outwardly. In this phase, the front end flap 36 is not fastened to the side flaps 32, so here the flap 36 should be supported by an outer, non-illustrated guiding rail in the box erection line.

The box is now ready to receive its contents, for example, pastils, which can be loaded through the open broad side.

Figure 3:
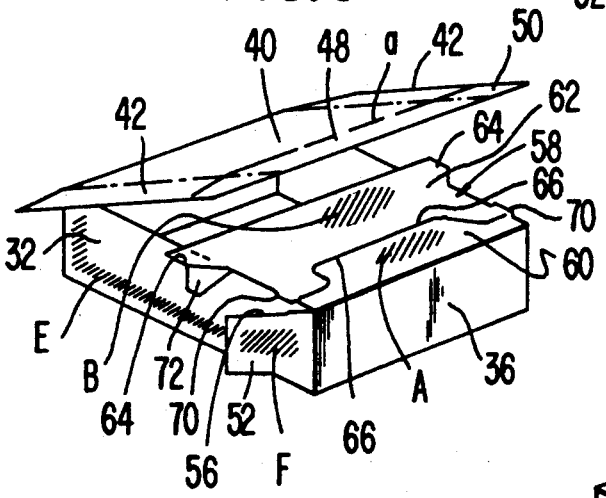

Thereafter, as illustrated in FIG. 3, the foremost top panel 58 is folded inwardly over the box, and the side lugs 52 on the front flap 36 are folded rearwardly along the side flaps 32, yet still without being fastened thereto. Thereafter, the opposite top panel 40,48 is folded forwardly over the box, which it covers at full length, while the underlying upper panel 58 covers only about half the length of the box. Just prior to the final folding down of the top panel 40,48, for example, in the condition shown in FIG. 3, a non-illustrated hot air nozzle tongue is swung into the space between the two upper panels, such that in a precisely controlled manner jets of hot air are sent against the two hatched areas A and B of the upper panel 58 as well as against the correspondingly located area portions of the underside of the top panel 40,48. These areas are shown at C and D in FIG. 2. The carton blank is coated with a plastic layer that is softened by heating, whereby the two opposed area groups will be welded together by the following folding down of the top panel 40,48, upon retraction of the said nozzle tongue. Alternatively, the joining can be effected by means of glue.

The cutting line a of the upper top panel 40,48 is spaced from the front end 36 slightly more spaced therefrom than the cutting line portion f of the lower top panel 58.

Thereafter the side flaps 42,50 of the top panel 40,48 are folded down, whereby the outwardly projecting side lugs 64 of the panel 58 are forced to be folded down. As shown, the side flaps or panels 32 may be provided with notches 72 that may lock these lugs against the panel 58 being pulled forwardly.

By the folding down of the side flaps 42,50, care is taken so that the flap portions 42 at the rear and at the bottom are secured by gluing or welding to the outside of the inner side flaps 32 as illustrated by a hatched area E in FIG. 3, while the foremost flap portions 50 are correspondingly fastened to the outside of the rearwardly folded lugs 52 of the front end flap 36, see hatched area F. The lugs 52 are not fastened to the innerlying surfaces of the side flaps 32.

Figure 4:
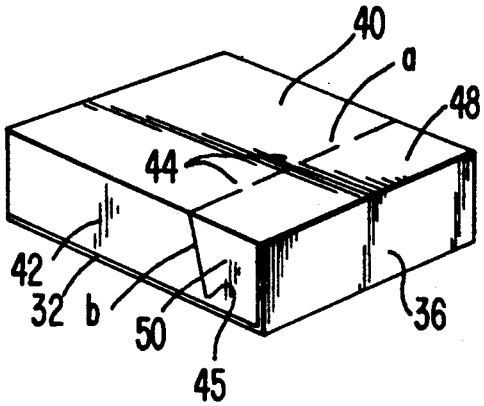

Hereafter, the box will be filled and closed as shown in FIG. 4. The box will be 'guarantee closed', inasfar as it cannot be opened unless the discontinued portions 44 of the cutting line a and the areas 46 of the cutting lines b are broken.

Figure 5:
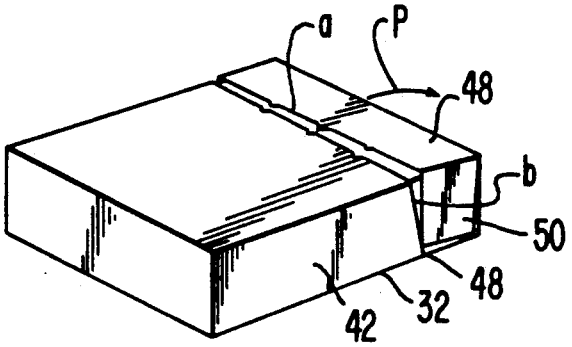
FIGS. 5–7 are perspective views illustrating the opening of the box.

On the other hand, the box is easily opened by pressing down the central portion of the top panel 40, whereby the areas 44 are broken. Thereafter, as shown in FIG. 5 by an arrow P, the upper front edge of the box is pushed forwardly, whereby is effected an initial opening of a cap lid member consisting of the flap and lug portions 36,48,50, 52 and 60. This member is swung out about its lower line of connection with the body of the box, viz. the folding line between the blank portions 30 and 36, as further illustrated in FIGS. 6 and 7.

By the initial opening of this lid member, both the areas 46 of cutting line b and the areas 66 of cutting line c will be broken. Thus, these non-cut areas will be of no primary importance for the guarantee sealing of the box, but the areas 66 are important because they will facilitate the production of boxes based on a single coherent blank (FIG. 1). The areas 46, which will also be broken, are important for securing that the associated free corners of the joined lugs 50 and 52 are held safely against the box sides until the box is intentionally opened; otherwise the corner could project outwardly from the box side and thus cause unintentional damage to the packing.

Figure 6:
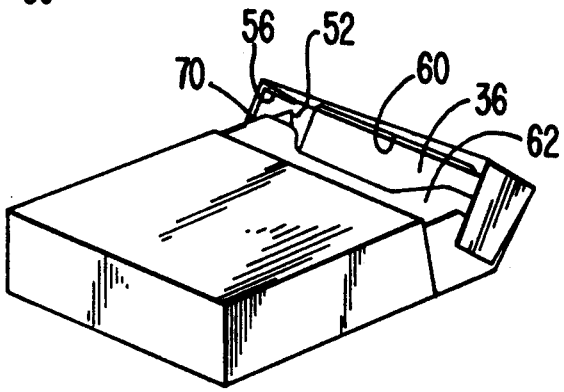
Figure 7:
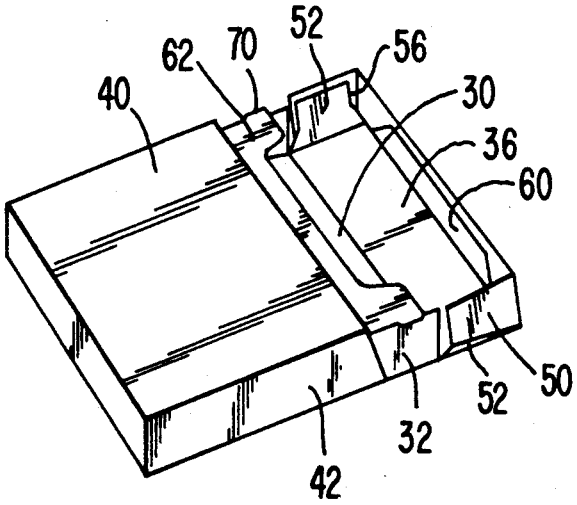

However, by the initial or continued opening of the lid member another very important event will occur:

As best understood from viewing FIGS. 3 and 6, the outwardly projecting ear portions 70 on the lower top panel 62 in the closed box will project into a space which is upwardly confined by the underside of the foremost portion 48 of the upper panel 40,48, while it is downwardly confined by the top edge portion of the lug 52 as folded inwardly from the front flap 36. The reference numeral 56 designates a recess. The upper edges 56A of the lugs five, by virtue of the recesses 56, will be spaced from the underside of the front flap or panel 60 such that the ear portions 70 will be received in these spaces. Consequently, when the lid member is opened, the recess edges 56A have to be pulled outwardly from their engagement with the protruding ear portions 70, whereby an opening of the lid member is resisted by a noticeable retaining action by the said ear portions 70.

When the lid member is reclosed, the engagement between the ear portions 70 and the recesses 56 will be reestablished such that the subsequent opening of the lid member can hardly be effected fully unintentionally.

Thus, the invention provides for a highly desirable snap locking of the lid, irrespective that the lid member is the said cap type or neck-box type. As mentioned, for pastils the cap type with its serving tray design (FIG. 7) is preferable over neck-boxes, and the invention provides the important result that the cap lids are now closeable as safely as the hood lids of the neck-boxes.

Moreover, the disclosed box is highly advantageous in that it can be factory closed as a guarantee-sealed packet.

It will be noted that in fact the box will appear as a neck-box, with the free lid edges located flush with the top and side panels of the box, i.e. in a protected countersunk manner, duly supported by the neck panel 62.

Figure 8:
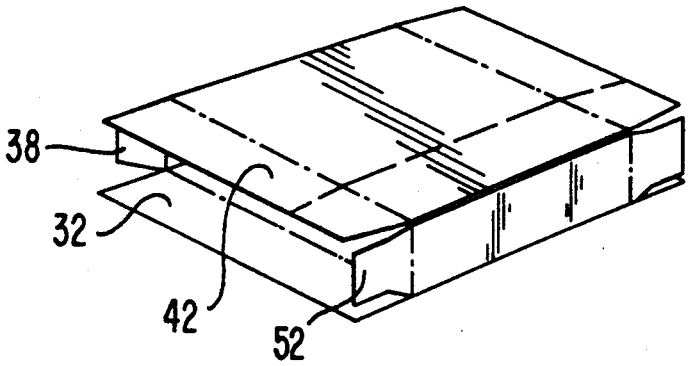
FIG. 8 is a view of a modified box member.
Figure 9:
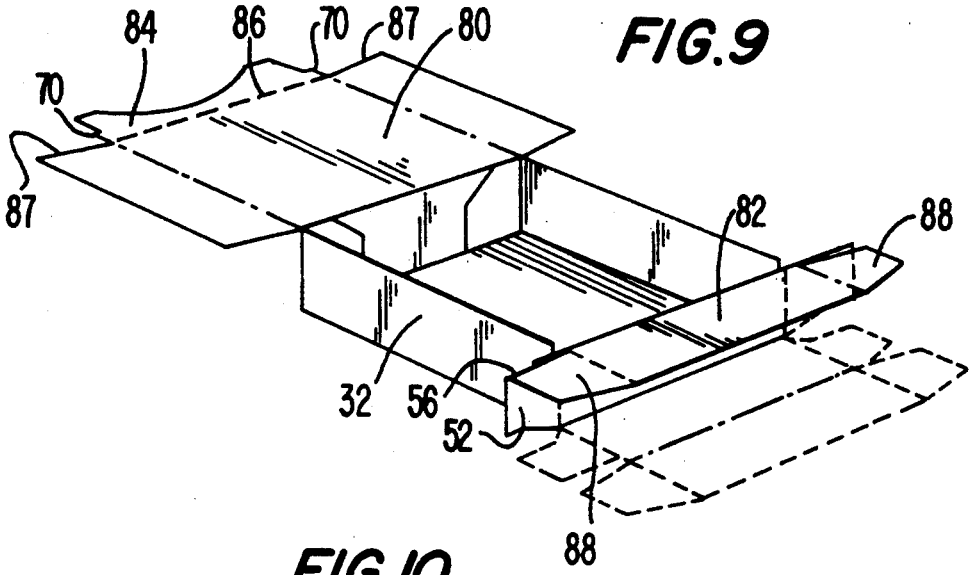
FIGS. 9–12 are views illustrating another modified box.
Figure 10:
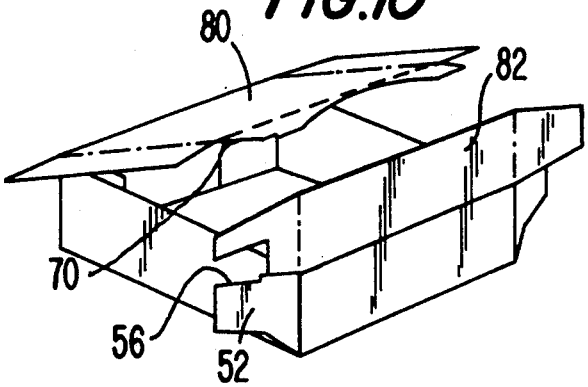
Figure 11:
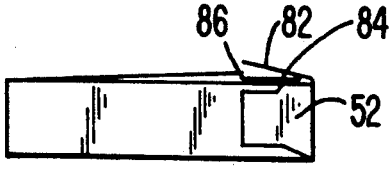
Figure 12:
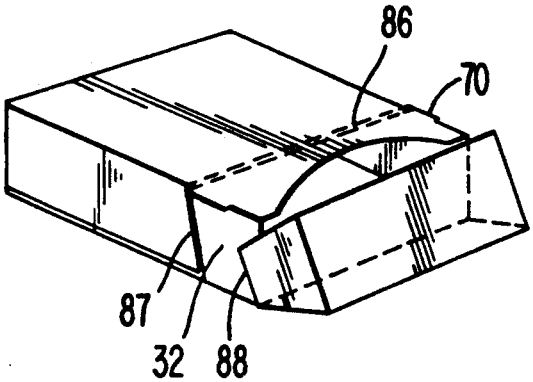

The box can be prepared as a tubular member with open sides, see FIG. 8, such that it can be folded flat from this shape or rather produced in the flat shape for compact shipment to the user's factory, where it is folded up to the tubular shape and closed at one side. The it is filled through the other side, which is thereafter closed. The respective side portions should be closed in the sequence 38-32-52-42, whereby the closed box will be as shown in FIG. 4.

FIGS. 9–12 illustrate a simplified embodiment, which is usable when a guarantee closing is not required for example, if the box is completed with a film envelope. Compared with FIG. 1 both of the top panels are made shorter, and here the rear top panel, 80, is folded down prior to the closing of the front top panel, 82. These two panels are mutally not connected, but the outermost portion 84 of the panel 80 is pressed slightly offset along a cross line 86, whereby a neck effect is provided by the portion 84. The locking ears 70 are provided on the sides of this portion, still for cooperation with the recesses 56. The lid is formed simply by joining the lugs 52 with the side lugs 88 on the top panel 82, and the lid sides will be flush with the side flaps of the rear top panel 80.

We claim:

1. A dispenser box of a hinged lid type including:

box panel portions to form said dispenser box;

a hood shaped lid hinged to a rear edge of a box mouth of said dispenser box, said hood shaped lid having a lid panel and skirt portions covering a portion of the box panel portions adjacent to the box mouth at a front side of said dispenser box and at lateral sides of said dispenser box, the skirt portions having exterior layers detachably connected to said dispenser box by a perforation line with additional exterior portions of the front side and the lateral sides of the dispenser box; and interior neck plate portions projecting beyond the perforation line to be covered by the skirt portions of the hood shaped lid; and wherein an interior neck plate portion of said interior neck plate portions at the front side is formed from a prolongation of an interior layer of a front skirt portion of the skirt portions, the interior layer being formed from a prolongation of the lid panel and having a free edge spaced between the perforation line and a bottom line of a box front panel of the box panel portion for sealing said dispenser box by holding said hood shaped lid between a free end portion of the interior layer and an interior of an exterior front panel portion of the additional exterior portions, said interior layer having a transverse perforation line formed spaced from the perforation line and spaced from the lid panel of the closed hood shaped lid, an exterior front skirt layer of said exterior layers not being sealed to the portion of said interior layer between the two perforation lines.

2. A dispenser box according to claim 1, wherein the interior neck plate portions at the lateral sides includes end portions of interior side flaps of the dispenser box, these end portions not being sealed to the lid skirt portions.

3. A dispenser box according to claim 1, wherein said exterior front panel portion folds and is sealed to the interior layer as said dispenser box is erected to form a flat tube, said dispenser further including side flaps closable after said dispenser box is filled.

* * * * *